US009711850B2

(12) United States Patent
Naym et al.

(10) Patent No.: US 9,711,850 B2
(45) Date of Patent: Jul. 18, 2017

(54) DUAL ANTENNA TRACKING IN LEO AND MEO SATCOM

(71) Applicant: ORBIT COMMUNICATION SYSTEMS LTD, Netanya (IL)

(72) Inventors: Guy Naym, Netanya (IL); Hanan Keren, Kfar Sava (IL); Michael Greenspan, Givat Haim Meuhad (IL); Azriel Yakubovitch, Kfar Yona (IL); Miron Voin, Haifa (IL); Stav Gizunterman, Netanya (IL)

(73) Assignee: ORBIT COMMUNICATION SYSTEMS LTD, Netanya (IL)

( * ) Notice: Subject to any disclaimer, the term of this patent is extended or adjusted under 35 U.S.C. 154(b) by 0 days.

(21) Appl. No.: 14/961,917

(22) Filed: Dec. 8, 2015

(65) Prior Publication Data

US 2016/0164173 A1 Jun. 9, 2016

Related U.S. Application Data

(60) Provisional application No. 62/088,702, filed on Dec. 8, 2014.

(51) Int. Cl.
*H01Q 3/08* (2006.01)
*H01Q 1/12* (2006.01)
*H01Q 21/28* (2006.01)

(52) U.S. Cl.
CPC ..... *H01Q 3/08* (2013.01); *H01Q 1/125* (2013.01); *H01Q 21/28* (2013.01)

(58) Field of Classification Search
CPC ..... H01Q 3/08; H01Q 1/125; H01Q 21/28
See application file for complete search history.

(56) References Cited

U.S. PATENT DOCUMENTS 6,243,046 B1 * 6/2001 Aoki ..... H01Q 3/08 343/765
6,486,845 B2 * 11/2002 Ogawa ..... H01Q 1/42 343/757
9,000,995 B2 * 4/2015 Blaney ..... H01Q 25/00 248/550

* cited by examiner

*Primary Examiner* — Hoang Nguyen
(74) *Attorney, Agent, or Firm* — Mark M. Friedman

(57) ABSTRACT

Control of dual (two) antennas, for satellite communications (satcom) with satellites in one or more constellations in Low Earth Orbit (LEO) and Medium Earth Orbit (MEO). The dual antennas are typically part of a ground-based antenna system, in particular using the Satrack single pedestal with split antenna design, housed efficiently under a compact radome. Features simultaneous pointing toward two separate satellites during the satellites' handover/switching periods with instantaneous transition between the satcom modems for assuring real-time, continuous data communication over a LEO/MEO satellite link. The dual (two) antennas system can also be used in a "monopulse/electronic scan" mode where a first antenna is used for tracking according to ephemeris data, while a second antenna on the same pedestal will scan for offset/compensation to the first antenna path.

17 Claims, 11 Drawing Sheets

1. Az
2. X
3. $Y_1$
4. $Y_2$

| Input Parameter | Terminal | Satellite-1 | Satellite-2 |
|---|---|---|---|
| | | | |
| Latitude [°] | 27.00 | 20.00 | 40.00 |
| Longitude [°] | 36.00 | 25.00 | 45.00 |
| Altitude [ km ] | 0.00 | 950.00 | 950.00 |
| | | | |
| Derived Output Parameter | | | |
| Antenna Elevation [°] | | 26.69 | 20.28 |
| Antenna Azimuth [°] | | -122.46 | 27.60 |
| | | | |

Values found for simultaneous pointing toward 2 Satellites by the Satrack split Antenna design

| Option No. | Az [ψ°] | Xa [θ°] | Xb [θ°] | Y1 [φ°] | Y2 [φ°] |
|---|---|---|---|---|---|
| 1 | -17.00 | 27.65 | 27.76 | 13.77 | 41.90 |
| 2 | 163.00 | 27.65 | 27.76 | -13.77 | -41.90 |

| Values found for simultaneous pointing toward 2 Satellites by the Satrack split Antenna design | | | |
|---|---|---|---|
| | | | |
| Az | Xb | Y1 | Y2 |
| [ψ°] | [θ°] | [φ°] | [φ°] |
| | | | |
| -17.00 | 27.71 | 13.77 | 41.90 |
| | | | |

FIGURE 5

| Input Parameter | Terminal | Sat @ min 1 | Sat @ min 2 | Sat @ min 3 | Sat @ min 4 | Sat @ min 5 | Sat @ min 6 |
|---|---|---|---|---|---|---|---|
| | | | | | | | |
| Latitude [°] | 27.00 | 20.00 | 24.00 | 28.00 | 32.00 | 36.00 | 40.00 |
| Longitude [°] | 36.00 | 25.00 | 29.00 | 33.00 | 37.00 | 41.00 | 45.00 |
| Altitude [ km ] | 0.00 | 950.00 | 950.00 | 950.00 | 950.00 | 950.00 | 950.00 |
| | | | | | | | |

FIGURE 6

| | | | | | | | |
|---|---|---|---|---|---|---|---|
| | | | | | | | |
| Ant-1 Input Prms' | Terminal | Sat @ min 1 | Sat @ min 2 | Sat @ min 3 | Sat @ min 4 | Sat @ min 5 | Sat @ min 6 |
| Latitude [°] | 27.00 | 20.00 | 24.00 | 28.00 | 32.00 | 36.00 | 40.00 |
| Longitude [°] | 36.00 | 25.00 | 29.00 | 33.00 | 37.00 | 41.00 | 45.00 |
| Altitude [ km ] | 0.00 | 950.00 | 950.00 | 950.00 | 950.00 | 950.00 | 950.00 |
| | | | | | | | |
| Ant-1 Output Prms' | | | | | | | |
| Antenna-1 Elevation [°] | | 26.69 | 45.11 | 68.88 | 54.87 | 33.54 | 20.28 |
| Antenna-1 Azimuth [°] | | -122.48 | -113.88 | -68.72 | 9.63 | 24.07 | 27.60 |
| | | | | | | | |
| | | | | | | | |
| Ant-2 Input Prms' | Terminal | Sat @ min 1 | Sat @ min 2 | Sat @ min 3 | Sat @ min 4 | Sat @ min 5 | Sat @ min 6 |
| Latitude [°] | 27.00 | 40.00 | 36.00 | 32.00 | 28.00 | 24.00 | 20.00 |
| Longitude [°] | 36.00 | 45.00 | 41.00 | 37.00 | 33.00 | 29.00 | 25.00 |
| Altitude [ km ] | 0.00 | 950.00 | 950.00 | 950.00 | 950.00 | 950.00 | 950.00 |
| | | | | | | | |
| Ant-2 Output Prms' | | | | | | | |
| Antenna-1 Elevation [°] | | 20.28 | 33.54 | 54.87 | 68.88 | 45.11 | 26.69 |
| Antenna-1 Azimuth [°] | | 27.60 | 24.07 | 9.63 | -68.72 | -113.88 | -122.48 |
| | | | | | | | |

FIGURE 7A

| Satellite Trajectory Transition Time: | Satellite Type | Altitude Km | Round Time [sec] | Switch Period [sec] | Elev. $\Delta\theta/\Delta t$ [°/sec] |
|---|---|---|---|---|---|
| | | | | | |
| $T_1^2/R_1^3 = T_2^2/R_2^3$ | MEO | 8062 | 17316 | 2165 | 0.03 |
| | | | | | |
| $T_2 = T_1 \cdot (R_2/R_1)^{(3/2)}$ | LEO | 950 | 6260 | 261 | 0.27 |
| | | | | | |

FIGURE 10A

| Satellite Type | Altitude Km | Elev. $\Delta\theta/\Delta t$ [°/sec] | 1.2 m Ka Ant @ 30 GHz $\Delta T$ [Sec] to -3 dB Contour | 2.1 m Ka Ant @ 30 GHz $\Delta T$ [Sec] to -3 dB Contour |
|---|---|---|---|---|
| | | | | |
| MEO | 8062 | 0.03 | 8.97 | 5.10 |
| | | | | |
| LEO | 950 | 0.27 | 1.08 | 0.61 |
| | | | | |

FIGURE 10B

DUAL ANTENNA TRACKING IN LEO AND MEO SATCOM

CROSS-REFERENCE TO RELATED APPLICATIONS

This application claims the benefit of provisional patent application (PPA) Ser. No. U.S. 62/088,702, filed Dec. 8, 2014 by the present inventors, which is incorporated by reference in its entirety herein.

This application uses the Satrack pedestal with split antenna design disclosed in U.S. Pat. No. 6,310,582, granted Oct. 30, 2001.

FIELD OF THE INVENTION

The present invention generally relates to antennas, and in particular, it concerns antenna control.

BACKGROUND OF THE INVENTION

Real-time, continuous data communication can be implemented using a constellation of LEO (low Earth orbit) and MEO (medium Earth orbit) satellites. In order to implement satellite communication (satcom), a ground-based antenna system can be used.

SUMMARY

According to the teachings of the present embodiment there is provided a method for pointing a dual antenna toward a first satellite and second satellite, the dual antenna including a pedestal with mounted first antenna and second antenna, the method including the steps of: receiving pedestal location data including pedestal latitude, pedestal longitude, and pedestal altitude for the pedestal; receiving ephemeris data for the first satellite and the second satellite, the ephemeris data including respective satellite latitude, satellite longitude, satellite altitude, and orbit radius; calculating antenna pointings, based on the pedestal location data and the ephemeris data, the antenna pointings including:

a first antenna elevation to the first satellite, a first antenna azimuth to the first satellite, a second antenna elevation to the second satellite, and a second antenna azimuth to the second satellite, receiving pedestal misalignment data including pedestal yaw, pedestal pitch, and pedestal roll; calculating corrected antenna pointings, based on the antenna pointings and the pedestal misalignment data, the corrected antenna pointings including:

a first antenna corrected elevation to the first satellite, a first antenna corrected azimuth to the first satellite, a second antenna corrected elevation to the second satellite, and a second antenna corrected azimuth to the second satellite, receiving varied yaw, pitch, and roll values; deriving continuously the instantaneous corrected pointings, based on the corrected antenna pointings and the varied yaw values, the corrected pointings including:

a first antenna derived elevation to the first satellite, a first antenna derived azimuth to the first satellite, a second antenna derived elevation to the second satellite, and a second antenna derived azimuth to the second satellite, calculating axis angles for the dual antenna, based on the corrected pointings, the axis angles including for each yaw value:

first antenna lower and upper X-axis angles, first antenna lower and upper Y-axis angles, second antenna lower and upper X-axis angles, and second antenna lower and upper Y-axis angles, and deriving continuously the instantaneous working point axis angles, based on the axis angles, the working point axis angles including for a given yaw, pitch, and roll values:

a dual antenna azimuth angle, a dual antenna X-axis angle, a first antenna Y-axis angle, and a second antenna Y-axis angle In an optional embodiment, the pedestal misalignment data is derived from the pedestal installation. In another optional embodiment, subsequent pedestal misalignment data is derived from the pedestal dynamic movement. In another optional embodiment, the varied yaw values are from 180° to +180° at the instantaneous pitch and roll values of the platform plate carrying the pedestal, in 0.1° steps. In another optional embodiment, further including the step of: initiating pointing of the dual antenna based on the working axis angles. In another optional embodiment, the pointing includes configuring a single azimuth axis with the dual antenna azimuth angle, configuring a single X-axis with the dual antenna X-axis angle, configuring a Y1-axis of the first antenna with the first antenna Y-axis angle, and configuring an Y2-axis of the second antenna with the second antenna Y-axis angle.

According to the teachings of the present embodiment there is provided a system for pointing an antenna, including: a dual antenna including a pedestal with mounted first antenna and second antenna, a processing system containing one or more processors, the processing system being configured to: receive pedestal location data including pedestal latitude, pedestal longitude, and pedestal altitude for the pedestal; receive ephemeris data for the first satellite and the second satellite, the ephemeris data including respective satellite latitude, satellite longitude, satellite altitude, and orbit radius; calculating antenna pointings, based on the pedestal location data and the ephemeris data, the antenna pointings including:

a first antenna elevation to the first satellite, a first antenna azimuth to the first satellite, a second antenna elevation to the second satellite, and a second antenna azimuth to the second satellite, receive pedestal misalignment data including pedestal yaw, pedestal pitch, and pedestal roll; calculate corrected antenna pointings, based on the antenna pointings and the pedestal misalignment data, the corrected antenna pointings including:

a first antenna corrected elevation to the first satellite, a first antenna corrected azimuth to the first satellite, a second antenna corrected elevation to the second satellite, and a second antenna corrected azimuth to the second satellite, receive varied yaw, pitch, and roll values; derive continuously the instantaneous corrected pointings, based on the corrected antenna pointings and the varied yaw values, the corrected pointings including:

a first antenna derived elevation to the first satellite, a first antenna derived azimuth to the first satellite, a second antenna derived elevation to the second satellite, and a second antenna derived azimuth to the second satellite, calculate axis angles for the dual antenna, based on the corrected pointings, the axis angles including for each yaw value:

first antenna lower and upper X-axis angles, first antenna lower and upper Y-axis angles, second antenna lower and upper X-axis angles, and second antenna lower and upper Y-axis angles, and derive continuously the instantaneous working point axis angles, based on the axis angles, the working point axis angles including for a given yaw, pitch, and roll values:

a dual antenna azimuth angle, a dual antenna X-axis angle, a first antenna Y-axis angle, and a second antenna Y-axis angle In an optional embodiment, the processing system is further configured to: initiate pointing of the dual antenna based on the working axis angles. In another optional embodiment, the dual antenna includes: a first rotation mechanism supporting a first antenna rotatably in a first rotation direction centering around a first axis; a second rotation mechanism supporting a second antenna rotatably in the first rotation direction centering around a second axis running along or in parallel to the first axis; an elevation angle adjusting mechanism for rotatably supporting the first and second rotation mechanisms commonly in a second rotation direction, centering around a third axis different from the first axis and the second axis; and an azimuth angle adjusting mechanism for rotatably supporting the elevation angle adjusting mechanism in a third rotation direction, centering around a fourth axis different from the first axis and the third axis; wherein the first rotation mechanism is provided in a first area partitioned by a plane containing the third axis and running in parallel to the fourth axis, and the second rotation mechanism is provided in a second area opposite to the first area.

In another optional embodiment, pointing includes configuring the fourth axis with the dual antenna azimuth angle, configuring the third axis with the dual antenna X-axis angle, configuring the first axis of the first antenna with the first antenna Y-axis angle, and configuring the second axis of the second antenna with the second antenna Y-axis angle.

According to the teachings of the present embodiment there is provided a method for tracking a satellite using a dual antenna including a pedestal with mounted first antenna and second antenna, the method including the steps of: receiving a first peak detector output corresponding to a received signal at the first antenna and a second peak detector output corresponding to the received signal at the second antenna; generating respective logarithmic amplifications of the first and second peak detector outputs; and generating a difference amplification of the logarithmic amplifications; wherein the value of the difference amplification indicates if the first antenna should be pointed in the direction of the second antenna, or if the second antenna should be pointed in the direction of the first antenna, thereby tracking the satellite.

In another optional embodiment, further including the step of: initiating changing pointing direction of the first or second antenna based on the difference amplification. In another optional embodiment, further including the step of: switching, during a handover, control of the first and second antennas to an open loop configuration. In another optional embodiment, the first antenna is offset from the second antenna by a difference in the range of 0.05° to 0.15°.

According to the teachings of the present embodiment there is provided a system for tracking, including: a dual antenna including a pedestal with mounted first antenna and second antenna, a processing system containing one or more processors, the processing system being configured to: receive a first peak detector output corresponding to a received signal at the first antenna and a second peak detector output corresponding to the received signal at the second antenna; generate respective logarithmic amplifications of the first and second peak detector outputs; and generate a difference amplification of the logarithmic amplifications; wherein the value of the difference amplification indicates if the first antenna should be pointed in the direction of the second antenna, or if the second antenna should be pointed in the direction of the first antenna, thereby tracking the satellite.

In an optional embodiment, the processing system is further configured to: initiate changing pointing direction of the first or second antenna based on the difference amplification.

In another optional embodiment, the dual antenna includes: a first rotation mechanism supporting a first antenna rotatably in a first rotation direction centering around a first axis; a second rotation mechanism supporting a second antenna rotatably in the first rotation direction centering around a second axis running along or in parallel to the first axis; an elevation angle adjusting mechanism for rotatably supporting the first and second rotation mechanisms commonly in a second rotation direction, centering around a third axis different from the first axis and the second axis; and an azimuth angle adjusting mechanism for rotatably supporting the elevation angle adjusting mechanism in a third rotation direction, centering around a fourth axis different from the first axis and the third axis; wherein the first rotation mechanism is provided in a first area partitioned by a plane containing the third axis and running in parallel to the fourth axis, and the second rotation mechanism is provided in a second area opposite to the first area.

According to the teachings of the present embodiment there is provided a non-transitory computer-readable storage medium having embedded thereon computer-readable code for pointing a dual antenna toward a first satellite and second satellite, the dual antenna including a pedestal with mounted first antenna and second antenna, the computer-readable code including program code for:

receiving pedestal location data including pedestal latitude, pedestal longitude, and pedestal altitude for the pedestal; receiving ephemeris data for the first satellite and the second satellite, the ephemeris data including respective satellite latitude, satellite longitude, satellite altitude, and orbit radius; calculating antenna pointings, based on the pedestal location data and the ephemeris data, the antenna pointings including:

a first antenna elevation to the first satellite, a first antenna azimuth to the first satellite, a second antenna elevation to the second satellite, and a second antenna azimuth to the second satellite, receiving pedestal misalignment data including pedestal yaw, pedestal pitch, and pedestal roll; calculating corrected antenna pointings, based on the antenna pointings and the pedestal misalignment data, the corrected antenna pointings including:

a first antenna corrected elevation to the first satellite, a first antenna corrected azimuth to the first satellite, a second antenna corrected elevation to the second satellite, and a second antenna corrected azimuth to the second satellite, receiving varied yaw, pitch, and roll values; deriving continuously the instantaneous corrected pointings, based on the corrected antenna pointings and the varied yaw values, the corrected paintings including:

a first antenna derived elevation to the first satellite, a first antenna derived azimuth to the first satellite, a second antenna derived elevation to the second satellite, and a second antenna derived azimuth to the second satellite, calculating axis angles for the dual antenna, based on the corrected pointings, the axis angles including for each yaw value:

first antenna lower and upper X-axis angles, first antenna lower and upper Y-axis angles, second antenna lower and upper X-axis angles, and second antenna lower and upper Y-axis angles, and deriving continuously the instantaneous working point axis angles, based on the axis angles, the working point axis angles including for a given yaw, pitch, and roll values:

a dual antenna azimuth angle, a dual antenna X-axis angle, a first antenna Y-axis angle, and a second antenna Y-axis angle According to the teachings of the present embodiment there is provided a computer program that can be loaded onto a server connected through a network to a client computer, so that the server running the computer program constitutes a processing system (such as controller 1110) in a system according to any one of the above claims.

BRIEF DESCRIPTION OF FIGURES

The embodiment is herein described, by way of example only, with reference to the accompanying drawings, wherein:

FIG. 5 a table of exemplary values found for simultaneous pointing toward two satellites.

FIG. 6, a table of exemplary parameters for pointing at (on) LEO satellites.

FIG. 7A, a table of generated antennas elevation and azimuth.

FIG. 10A, a table of analyzed satellite trajectory transition times for antenna beams.

FIG. 10B, a table of satellite trajectory transition times for antenna beamwidth.

DETAILED DESCRIPTION

First Embodiment FIGS. 1 to 13

Figure 1:
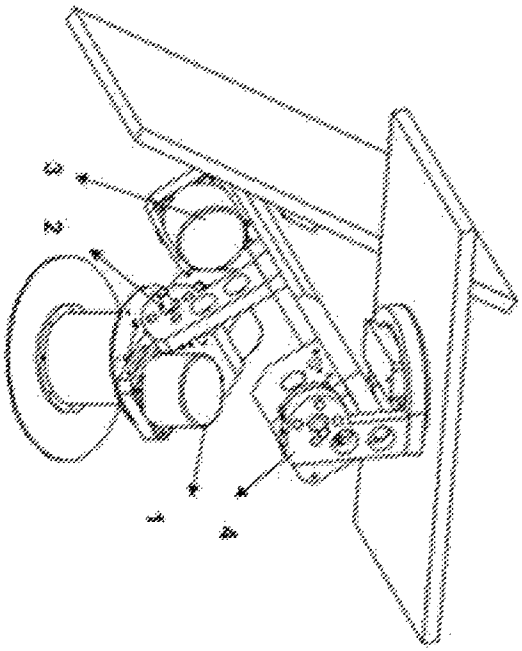
FIG. 1, a sketch of the single pedestal with split antenna design.

The principles and operation of the system and method according to a present embodiment may be better understood with reference to the drawings and the accompanying description. A present invention is a system and method for control of dual (two) antennas, in particular for satellite communications (satcom , Satcom) with satellites in one or more constellations in low Earth orbit (LEO) and medium Earth Orbit (MEO). The dual antennas are typically part of a ground-based antenna system. In this description, an exemplary implementation is described using the Satrack single pedestal with split antenna design (also referred to in this description as "Satrack", "Satrack antenna", "split antenna" and "residential dual half-moon antenna"), as described in U.S. Pat. No. 6,310,582. One skilled in the art will realize that this description is a non-limiting example, and the system and method can be implemented with other antenna systems, for example a system of two single antennas, and with other communications, for example communications with an airplane or other moving objects.

Initial work on the Satrack antenna was done in 1999-2001 under the "SkyBridge" and "Teledesic" programs (40-80 LEO Satellites constellations at Ku & Ka), resulting in a compact mechanical/control concept for this type of application. The Satrack antenna can be housed efficiently within a radome in a half moon shape. This configuration facilitates simultaneous pointing toward two separate satellites during the handover/switching periods, with instantaneous transition between the satcom modems for assuring real, continuous data communication over the LEO satellites link.

Initial work on the Satrack antenna was done with a team including the current inventors of Orbit Communications Systems and "Sharp Kabushiki Kaisha" (Osaka, JP). On behalf of the team, Sharp Kabushiki Kaisha filed what became U.S. Pat. No. 6,310,582 with Orbit "right to use". In U.S. Pat. No. 6,310,582, only a mechanical structure of a 4 axes pedestal was described. The "SkyBridge" and "Teledesic" programs were abandoned, and control of the Satrack antenna remained unproven, specifically if simultaneous pointing toward two separate satellites by this kind of dual antenna design is possible. An important note is that while U.S. Pat. No. 6,310,582 includes a conventional, generic description of how antennas are typically controlled, U.S. Pat. No. 6,310,582 does not include a control algorithm. In other words, U.S. Pat. No. 6,310,582 lacks sufficient detail to implement a control algorithm for the Satrack antenna.

An example of the insufficient work in the industry, as compared to the innovation required for control of the Satrack antenna system, is that during the SkyBridge development process the conventional algorithms under discussion involved calculations with only three angular parameters. In contrast, tracking two targets simultaneously by the Satrack pedestal requires axiomatically dynamic calculation of four independent angular parameters, (e.g. Az, X, Y1 & Y2) as described below.

In the below description, first is presented a proof that the Satrack antenna can simultaneously point toward two separate satellites and provide a desired level of operation and performance to serve as a component of a solution for the above-described data communications (satcom).

Next is presented innovative control algorithms enabling the Satrack (or comparable) antenna (antenna system) to be used for this communications application.

Based on this description, one skilled in the art will be able to apply the current invention to antenna systems similar to Satrack, including, but not limited to implementing the below-described algorithms for a system of dual antennas (two antennas mounted either in conjunction or separately).

The system facilitates simultaneous pointing toward two separate satellites during the satellites' handover/switching periods with instantaneous transition between the satcom modems for assuring real-time, continuous data communication over a LEO/MEO satellite link. As LEO satellite constellations (for example, presently being considered by OneWeb and Space-X) are deployed, there will be an increased demand for compact dual-antenna systems, such as the four-axis dual-antenna system controlled by implementations of the current embodiment. The system facilitates efficiently housing within a single radome a system including two separate single pedestals or one dual antenna pedestal, with each antenna simultaneously and efficiently pointing toward two separate satellites down to very low elevation angles, e.g. 5° elevations.

The system can be used in a "monopulse/electronic scan" mode where the first antenna is used for tracking according to ephemeris data, while the second antenna on the same pedestal will scan to create the [±] error, which will be used as an offset/compensation to the first antenna path. This feature can be important in satcom over LEO/MEO Satellites due to relatively strongly varied EIRP (Equivalent Isotropically Radiated Power) of the moving LEO/MEO satellites over the narrow terminal antenna beamwidth, especially at Ku/Ka-bands.

Proof of Operation and Detailed Control Algorithm

Refer to FIG. 1, a sketch of the single pedestal with split antenna design. Four axis are shown, as described in the following list, along with the corresponding axis label in U.S. Pat. No. 6,310,582

| Axis | Function | U.S. Pat. No. 6,310,582 |
|---|---|---|
| 1. | Azimuth (Az) | X, Axis04 |
| 2. | Elevation (X) | Y, Axis03 |
| 3. | Y1 for a first antenna | Z, Axis01 |
| 4. | Y2 for a second antenna | Axis02 |

In general, the single pedestal with split antenna design (also referred to in this document as a single pedestal dual antenna design) is an antenna system including:

a first rotation mechanism supporting a first antenna rotatably in a first rotation direction centering around a first axis (axis-3, axis-Y1);

a second rotation mechanism supporting a second antenna rotatably in the first rotation direction centering around a second axis (axis-4, axis-Y2) running along or in parallel to the first axis;

an elevation angle adjusting mechanism for rotatably supporting the first and second rotation mechanisms commonly in a second rotation direction, centering around a third axis (axis-2, axis-X) different from the first axis and the second axis; and an azimuth angle adjusting mechanism for rotatably supporting the elevation angle adjusting mechanism in a third rotation direction, centering around a fourth axis (axis-1, axis-Az) different from the first axis and the third axis;

wherein the first rotation mechanism is provided in a first area partitioned by a plane containing the third axis and running in parallel to the fourth axis, and the second rotation mechanism is provided in a second area opposite the first area.

First is presented a proof that the single pedestal with split antenna design (such as Satrack) can simultaneously point toward two separate satellites or both antennas toward the same satellite (excluding the handover periods). Each Y-axis direction is located on the upper axis of the Y/X pedestal, where each split antenna is equivalent to a circular antenna of 30 to 120 cm, or even bigger if needed, provided that the beam polarization is circular in both satellites.

The pedestal concept design based on Y1 and Y2 over X over Azimuth is an Orbit concept, where the notations in the current figure are described with a view of the pedestal design with the split antenna in the Y-axis direction and used throughout the current description.

Figures 2A, 2B:
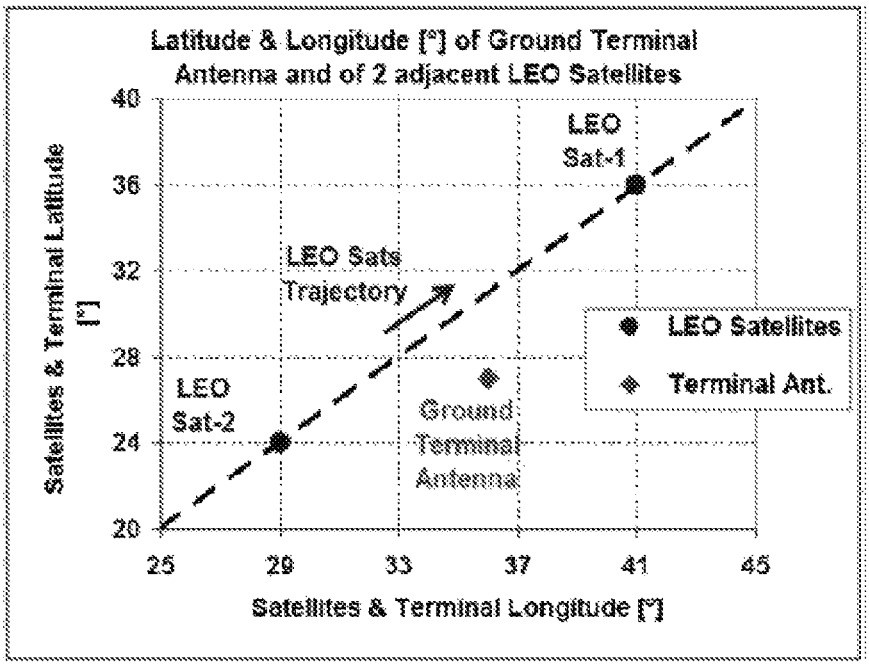
FIG. 2A, a plot of exemplary parameters for LEO satellites.
FIG. 2B, a table of exemplary parameters for LEO satellites.

Referring now to FIG. 2A, a plot and FIG. 2B, a table of exemplary parameters for LEO satellites. Without limitation on the generality in the following rigorous proof, arbitrary realistic parameters of latitude and longitude to ground terminal and two adjacent LEO satellites are assumed. These realistic parameters yield antenna elevation (El) and azimuth (Az) values as outlined in the current figures.

These antenna elevation and azimuth values are then used as input parameters in the following analyses showing the single pedestal with split antenna design in simultaneous pointing toward two separate satellites, for yielding Satrack X-Axis [θ°], Y1- and Y2-Axes [φ°] vs. Azimuth-Axis [ψ°] of each antenna for pointing toward satellite-1 and satellite-2, using the following pointing algorithm.

Figure 4:
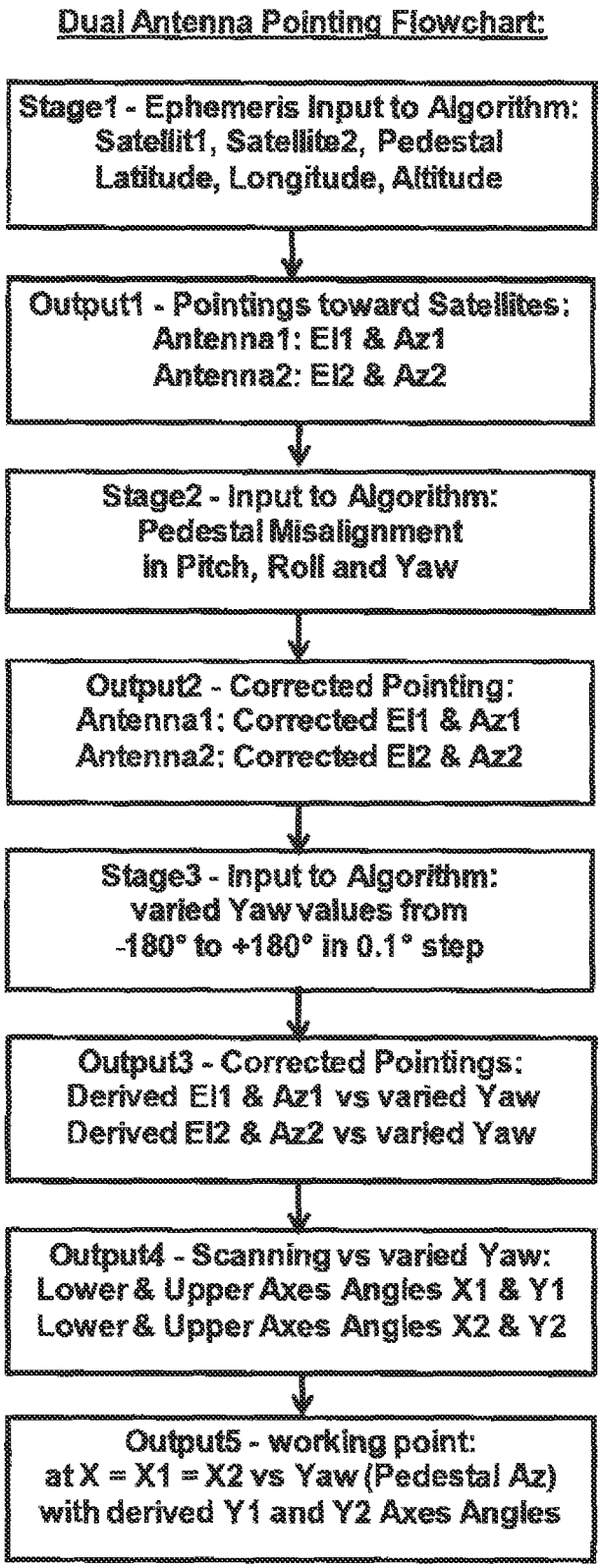
FIG. 4, a flowchart of an algorithm for dual antenna pointing.

Refer also to FIG. 4, a flowchart of an algorithm for dual antenna pointing (also referred to in this description simply as the "pointing algorithm"), showing a general method of implementing the following algorithm equations.

Algorithm to transform angles from Az-El Axes to X-Y platform axes:

1. Inputs to Algorithm

Stage1-Ephemeris Input to Algorithm: Satellite1, Satellite2, Pedestal Latitude, Longitude, Altitude.

Beam Pointing Toward Satellite:

El [°]=Elevation (up/down with respect to the Earth's horizon)

Az [°]=Azimuth (counter/clockwise on the Earth's horizon with respect to a North-South line)

These El and Az values are derived dynamically from the satellite ephemeris as follows:

| Terminal | Position | Unit |
|---|---|---|
| Latitude | αt | [°] |
| Longitude | βt | [°] |
| Altitude | Pa | KM |
| Earth Radius | Ro | KM |
| Ground Radius | Re = Ro + Pa | KM |

| Satellite | Ephemeris | Unit |
|---|---|---|
| Latitude | αs | [°] |
| Longitude | βs | [°] |
| Sat Altitude | Hs | KM |
| Orbit Radius | Rs = Re + Hs | KM |

Using the above set of parameters, the following equations are then used:

$$V1=Re\cdot\mathrm{Cos}(\alpha t\cdot\pi/180)\cdot\mathrm{Cos}(\beta t\cdot\pi/180)$$

$$V2=Re\cdot\mathrm{Cos}(\alpha t\cdot\pi/180)\cdot\mathrm{Sin}(\beta t\cdot\pi/180)$$

$$V3=Re\cdot\mathrm{Sin}(\alpha t\cdot\pi/180)$$

$$V4=\mathrm{Cos}(\beta t\cdot\pi/180)\cdot V1+\mathrm{Sin}(\beta t\cdot\pi/180)\cdot V2$$

$$V5=-\mathrm{Sin}(\beta t\cdot\pi/180)\cdot V1+\mathrm{Cos}(\beta t\cdot\pi/180)\cdot V2$$

$V6=V3$ $V7==\mathrm{Cos}((90-\alpha t)\cdot\pi/180)\cdot V4-\mathrm{Sin}((90-\alpha t)\cdot\pi/180)\cdot V6$ $V8=V5$ $V9=\mathrm{Sin}((90-\alpha t)\cdot\pi/180)\cdot V4+\mathrm{Cos}((90-\alpha t)\cdot\pi/180)\cdot V6$ $U1=Rs\cdot\mathrm{Cos}(\alpha s\cdot\pi/180)\cdot\mathrm{Cos}(\beta s\cdot\pi/180)$ $U2=Rs\cdot\mathrm{Cos}(\alpha s\cdot\pi/180)\cdot\mathrm{Sin}(\beta s\cdot\pi/180)$ $U3=Rs\cdot\mathrm{Sin}(\alpha s\cdot\pi/180)$ $U4=\mathrm{Cos}(\beta t\cdot\pi/180)\cdot U1+\mathrm{Sin}(\beta t\cdot\pi/180)\cdot U2$ $U5=-\mathrm{Sin}(\beta t\cdot\pi/180)\cdot U1+\mathrm{Cos}(\beta t\cdot\pi/180)\cdot U2$ $U6=U3$ $U7=\mathrm{Cos}((90-\alpha t)\cdot\pi/180)\cdot U4-\mathrm{Sin}((90-\alpha t)\cdot\pi/180)\cdot U6$ $U8=U5$ $U9=\mathrm{Sin}((90-\alpha t)\cdot\pi/180)\cdot U4+\mathrm{Cos}((90-\alpha t)\cdot\pi/180)\cdot U6$ $W1=U7-V7$ $W2=U8-V8$ $W3=U9-V9$ Output1+Pointings toward Satellites: Antenna1: El1 & Az1, Antenna2: El2 & Az2.

$El[°]=180/\pi*A\ \mathrm{Tan}(W3/\sqrt{(W1^2+W2^2)})$ $Az[°]=180-180/\pi*A\ \mathrm{Tan}(W2/W1)$ Stage2—Input to Algorithm: Pedestal Misalignment in Pitch, Roll, and Yaw.

Given the pedestal base plate misalignment:

ψ=Yaw (clockwise/counter to north-south of Earth horizon)

θ=Pitch (up/down of Earth horizon)

ϕ=Roll (cross up/down of Earth horizon)

The values of pedestal base plate misalignment are derived upon installation vs. the platform dynamics, where following is used:

2. Outputs from Algorithm in Stage 2

Output2—Corrected Pointing: Antenna1: Corrected El1 & Az1, Antenna2: Corrected El2 & Az2:

α=Corrected Antenna Azimuth

β=Corrected Antenna Elevation both angles are relative to the moving platform base plate carrying the dual antenna pedestal.

3. Outputs from Algorithm in Stage 2:

X=Pedestal Lower Axis Angle

Y=Pedestal Upper Axis Angle

Stage3—Input to Algorithm: varied yaw values from −180° to +180° in 0.1° step, pitch, and roll of the moving platform supporting the pedestal. The varied yaw values are at the instantaneous pitch and roll values of the platform plate carrying the pedestal.

Output3—Corrected Pointings: Derived El1 & Az1 and El2 & Az2 of Antenna1 and Antenna2 respectively vs. the varied yaw pitch and roll of the moving platform plate carrying the dual antenna pedestal. The corrected pointings are preferably derived continuously as instantaneous corrected pointings.

4. Equations for Corrected Azimuth and Elevation Angles:

$$\begin{bmatrix}\cos\alpha\cos\beta\\ \sin\alpha\cos\beta\\ -\sin\beta\end{bmatrix}=\begin{bmatrix}1&0&0\\0&\cos\phi&\sin\phi\\0&-\sin\phi&\cos\phi\end{bmatrix}\begin{bmatrix}\cos\theta&0&-\sin\theta\\0&1&0\\\sin\theta&0&\cos\theta\end{bmatrix}\begin{bmatrix}\cos\psi&\sin\psi&0\\-\sin\psi&\cos\psi&0\\0&0&1\end{bmatrix}\begin{bmatrix}\cos A\cos E\\ \sin A\cos E\\ -\sin E\end{bmatrix}$$

Values of the trigonometric functions for ϕ, θ, ϕ, can be derived upon installation of the antenna system and subsequently versus the platform dynamic, as also indicated in the next paragraph.

Output4—Scanning vs. varied yaw: Lower and upper axes angles X1 and Y1, and Lower and Upper Axes Angles X2 and Y2 respectively vs. varied yaw pitch and roll of the moving platform plate carrying the dual antenna pedestal, where the following abbreviations are used:

$E[rad]=El[°]\cdot\pi/180$ $A[rad]=Az[°]\cdot\pi/180$

5. Algorithm Implementation Equations:

$A1=\mathrm{Cos}(A)\cdot\mathrm{Cos}(E)$ $A2=-\mathrm{Sin}(A)\cdot\mathrm{Cos}(E)$ $A3=-\mathrm{Sin}(E)$ 5.1)

$B1=A1\cdot\mathrm{Cos}(\psi)+A2\cdot\mathrm{Sin}(\psi)$ $B2=-A1\cdot\mathrm{Sin}(\psi)+A2\cdot\mathrm{Cos}(\psi)$ $B3=A3$ 5.2)

$C1=B1\cdot\mathrm{Cos}(\theta)-B3\cdot\mathrm{Sin}(\theta)$ $C2=B2$ $C3=B1\cdot\mathrm{Sin}(\theta)+B3\cdot\mathrm{Cos}(\theta)$ 5.3)

$D1=C1$ $D2=C2\cdot\mathrm{Cos}(\phi)+C3\cdot\mathrm{Sin}(\phi)$ $D3=-C2\cdot\mathrm{Sin}(\phi)+C3\cdot\mathrm{Cos}(\phi)$ 5.4)

$\beta=a\ \sin(-D3)$ $\alpha=a\ \cos\ [D1/\mathrm{Cos}(\beta)]$ 5.5)

$X=a\ \tan\ [\ \mathrm{Tan}(\beta)/\mathrm{Sin}(\alpha)]$ $Y=a\ \sin\ [-\mathrm{Cos}(\alpha)\cdot\mathrm{Cos}(\beta)]$ 5.6)

Output5—working point: at X=X1=X2 vs. Yaw (pedestal Az=ψ−α) with derived Y1 and Y2 Axes Angles; while Output4 was derived for Antenna1 and Antenna2 individually vs. Yaw (Pedestal Az), Output5 search for the common working point value in the pedestal of X=X1=X2 where pointing toward two separate satellites by the 4-Axis antenna pedestal carrying the two antennas is achieved.

In the flowchart of the algorithm for dual antenna pointing, typically all the steps are performed sequentially, and all inputs and derived outputs are continually updated during operation of the antenna system (as long as pointing the antennas toward the satellites continues).

Figures 3A, 3B:
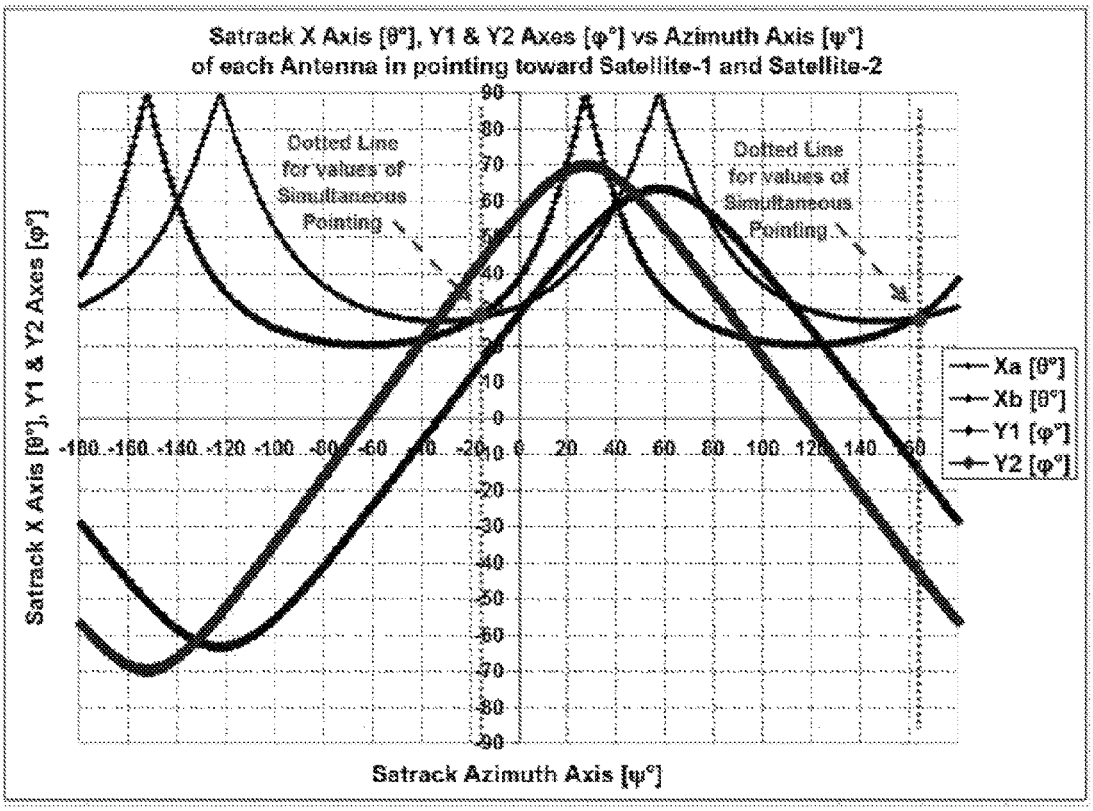
FIG. 3A, a plot of Satrack axis of each antenna toward each satellite.
FIG. 3B, a table of values for simultaneous pointing toward two satellites.

Refer to FIG. 3A, a plot of Satrack axis of each antenna toward each satellite. Using the above outlined pointing algorithm yields a plot shown in the current figure with multiple traces shown for each antenna Satrack X Axis [θ°], Y1, and Y2 Axes [ϕ°] vs. Azimuth Axis [ψ° ] for pointing toward satellite-1 and satellite-2.

Refer also to FIG. 3B, a table of values for simultaneous pointing toward two satellites. As the Y1 and Y2 Axes [ϕ°] are independently varied values, the calculated data traces serve for finding the exact azimuth value at the point where Xa=Xb (marked by bold dot), a working point that imposes the values in all four axes for the chosen practical solution (option #1 of FIG. 3B) to simultaneous pointing toward two separate satellites (option #2 is fold-over in Y1 and Y2).

Refer again to FIG. 2B and to FIG. 5 a table of exemplary values found for simultaneous pointing toward two satellites. The above proof demonstrates that the Satrack single pedestal with split antenna design can simultaneously point toward two separate satellites, as proved for arbitrary realistic parameters sets, and shown in summary in FIG. 2B and FIG. 5.

Simultaneous Pointing on Two LEO Satellites

Refer now to FIG. 6, a table of exemplary parameters for pointing at (on) LEO satellites. Without limitation on the generality in the following rigorous proof, arbitrary realistic parameters of latitude and longitude to ground terminal and two adjacent LEO satellites are assumed. These exemplary parameters are used in the FIG. 4 flowchart of an algorithm for dual antenna pointing for the below three calculated examples of Satrack pointing simultaneously toward two LEO Satellites:

The calculated first example for Satrack Az, X, Y1 & Y2 Axes [°] versus tracking time [min] in simultaneous pointing along LEO satellites trajectory on two adjacent LEO Satellites, is done using these exemplary latitude & longitude [°] for ground terminal antenna at 0° roll and for two adjacent LEO Satellites as input data to Stage1.

Figure 7B:
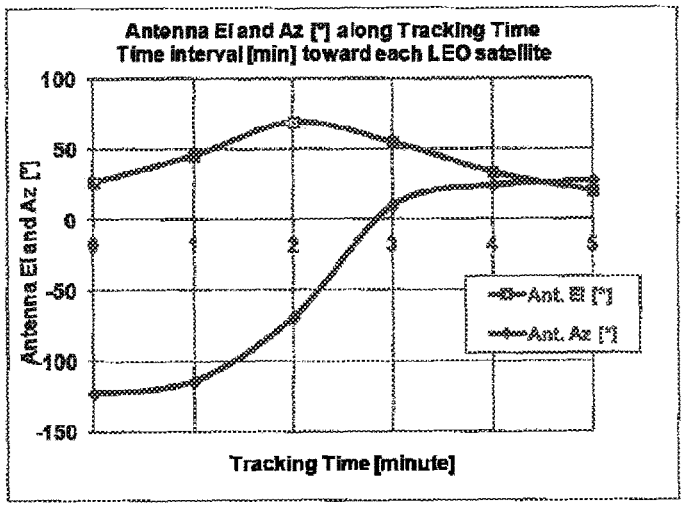
FIG. 7B, a trace of antenna elevation and azimuth.
Figure 7C:
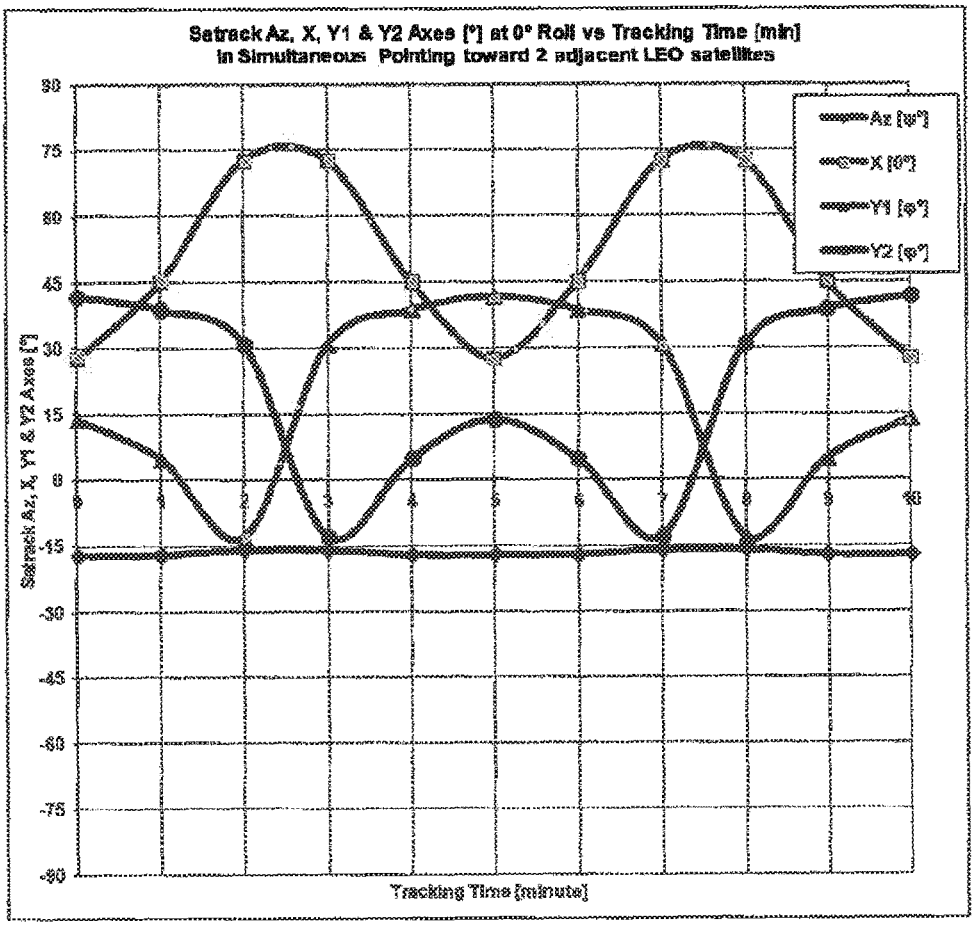
FIG. 7C, a trace of first example Az, X, Y1 & Y2 Axes.

Refer now to FIG. 7A, a table of generated antennas elevation and azimuth, FIG. 7B, a trace of antenna elevation and azimuth, and FIG. 7C, a trace of first example Az, X, Y1 & Y2 Axes. From the input data to Stage1, the pointing algorithm derives elevation and azimuth [°] versus tracking time [in minutes (min)] in pointing each of the two Satrack ground terminal antennas toward each LEO satellite. The derived El and Az are shown in the table of FIG. 7A and graphed in the trace of FIG. 7B.

These first example derived El and Az values can be used to analyze the Satrack Az, X, Y1 & Y2 Axes [°] versus tracking time interval [min] along the LEO satellites trajectory as shown in the trace of FIG. 7C. Note, in this first example the pedestal platform is at 0° roll.

Figure 8:
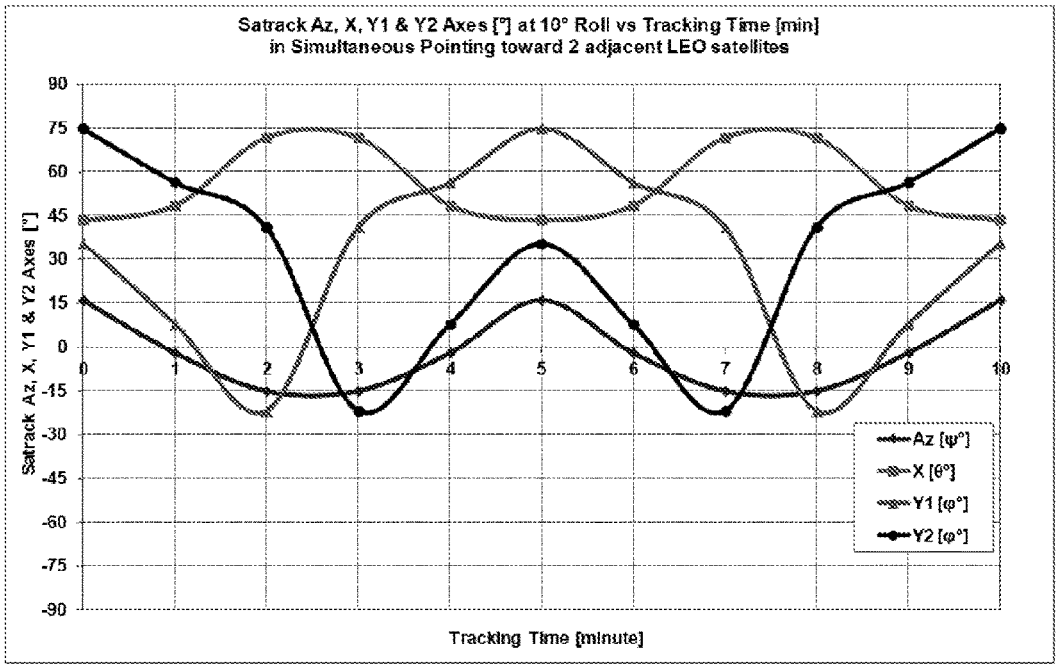
FIG. 8, a trace of second example Az, X, Y1 & Y2 Axes.

Refer now to FIG. 8, a trace of second example Az, X, Y1 & Y2 Axes. In this second example of pointing each of the two Satrack ground terminal antennas toward each of two LEO satellites, the pedestal platform is inclined at 10° roll. The derived values are plotted versus tracking time.

Figure 9:
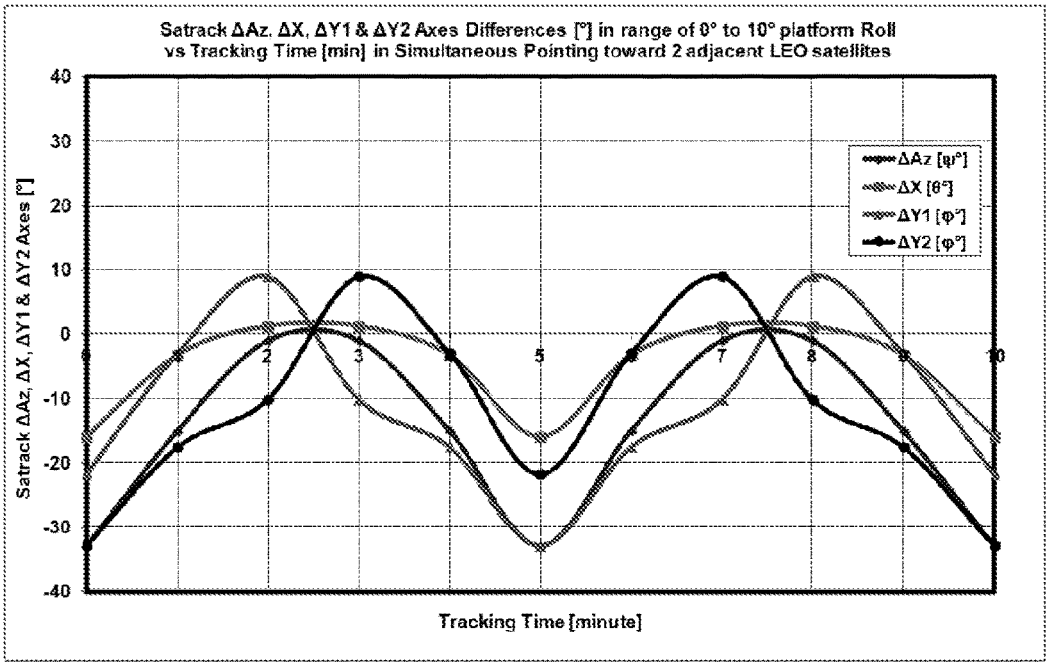
FIG. 9, a trace of third example ΔAz, ΔX, ΔY1, & ΔY2 Axes.

Refer now to FIG. 9, a trace of third example ΔAz, ΔX, ΔY1, & ΔY2 Axes. In this third example of pointing each of the two Satrack ground terminal antennas toward each of two LEO satellites, the pedestal platform roll is in the range of 0° to 10°. The derived Satrack ΔAz, ΔX, ΔY1, & ΔY2 Axes differences [°] values are plotted versus tracking time.

As can be seen from the above-described algorithm, proof, and examples, the Satrack pedestal with split antenna design onboard moving platform can provide simultaneous pointing toward two separate satellites with the desired levels of operation and performance.

RF Tracking

Based on the above-described method for pointing dual antennas (a single pedestal with split antenna design simultaneously pointing toward two separate satellites or both antennas toward the same satellite), the current system and method can be extended for use for RF (radio frequency) tracking. RF tracking, also referred to in the context of this document as "Monopulse/Electronic Scan", can be important in satcom over LEO/MEO satellites at Ku/Ka-bands due to the strongly varied EIRP of the moving LEO/MEO satellites over the narrow terminal antenna beamwidth as compared to EIRP variation of the terminal antenna at the allocated bandwidth of satcom with fixed satellites.

This RF Tracking concept may be very valuable in particular under a planned (in the year 2016) LEO satcom system, that is expected to be involved with 360 LEO Ku-band (or Ka-Band) satellites constellation in 18 planes of 20 satellites each, with half at an altitude of 950 km and the remainder at 800 km, inclined 88.2° relative to the equator.

Refer now to FIG. 10A, a table of analyzed satellite trajectory transition times for antenna beams, and FIG. 10B, a table of satellite trajectory transition times for antenna beamwidth. The analyzed scanning dynamics for antenna beam, results in

- 0.03°/s & 0.27°/s for MEO & LEO satellites respectively versus antennas beam widths of
  - 1.21° & 0.58° for 1.2 m Antenna @ 14.5 & 30 GHz respectively
  - 0.65° & 0.33° for 2.1 m Antenna @ 14.5 & 30 GHz respectively This implies accurate tracking importance, especially in case of LEO satellites due to the relatively short ΔT [Sec] to −3 dB contour of

Figure 11:
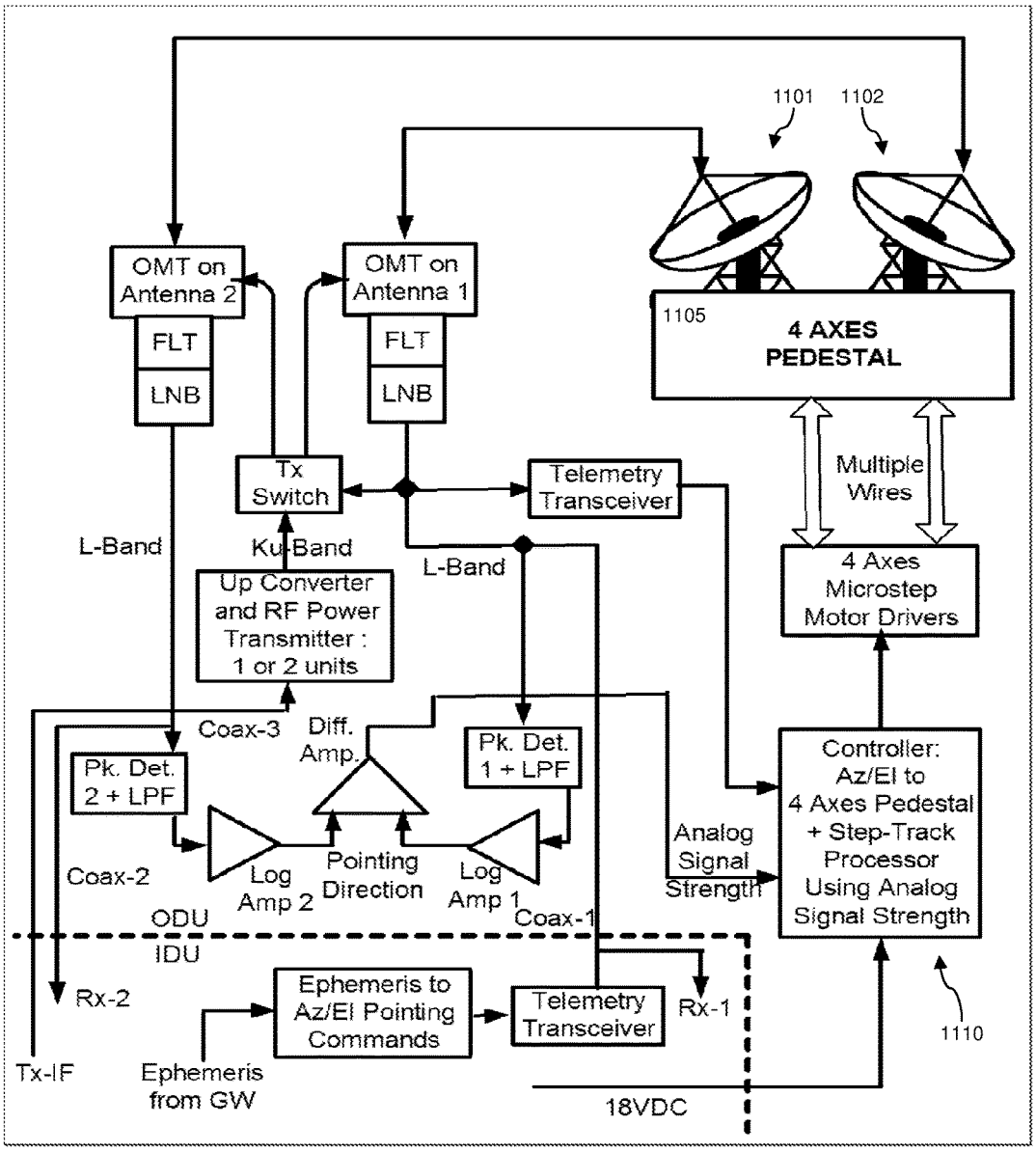
FIG. 11, a diagram of an exemplary tracking circuit design diagram for "Monopulse/Electronic Scan".

- 8.97 & 5.10 Sec for 1.2 m & 2.1 m Antennas @ 30 GHz vs. MEO respectively
- 1.08 & 0.61 Sec for 1.2 in & 2.1 m Antennas @ 30 GHz vs. LEO respectively Refer now to FIG. 11, a diagram of an exemplary tracking circuit design diagram for "Monopulse/Electronic Scan". A first antenna 1101 in the "Monopulse/Electronic Scan" will track according to ephemeris data, while a second antenna 1102 will scan to create the [±] Error, which will be used as an offset/compensation to the first antenna 1102 on the same pedestal 1105. In this case, the first antenna is referred to as the "reference antenna" and the second antenna is referred to as the "scan antenna", where in the current figure OMT stands for Orthogonal Modes Transducer and FLT stands for Filter to reject interference noise.

The closed loop control setup for antenna pointing exists at each of the two Rx channels, namely Rx-1 and Rx-2 at the LNB's (low noise block) output underneath the radome (not shown), and includes the following modules:

a. Peak detector connected to low pass filter of about 1 kHz (Pk. Det. 1+LPF, Pk. Det 1+LPF).
b. Logarithmic amplifier for the low passed analog signal (Log Amp 1, Log Amp 2), which convert the input level of the low passed analog signal to output signal with amplitude level proportional to logarithmic value of the input analog signal level.
c. Difference amplifier (Diff. Amp.) with inputs from a signals log, where the amplitude output level of signal log Amplifier is proportional to logarithmic value of the analog input signal level.

Preferably, one of the two antennas (1101, or 1102) should be in a slightly different direction (offset) from the other of the two antennas on the same pedestal 1105 in tracking a satellite. The slightly different direction should preferably be in the range of 0.05° to 0.15°, such as 0.1°. RF tracking will work without ambiguity (unambiguously) if the difference of the logarithmic values of the output of the logarithmic amplifiers (Log Amp 1, Log Amp 2) (originating from the two antennas (1101, 1102) will be used as follows: A positive value for the difference between the two logarithms implies pointing the reference antenna toward the scan antenna, while negative value would imply pointing the scan antenna toward the reference antenna.

The difference in the logarithmic values of the received signals (two signals, each from one of the two antennas (1101, or 1102)) is equivalent to the logarithm of a ratio of the values of the two received signals. Using the ratio will eliminate influence of variations in satellite EIRP on the pointing procedure. The low pass filter (LPF) at the output of the peak signal detector (Pk. Det.) increases the signal to noise ratio of the output signal (output from the peak detector) by the ratio of the input to the output bandwidth (of the peak detectors (Pk. Det. 1+LPF, Pk. Det. 1+LPF)) in case of uniform received EIRP per unit bandwidth.

This closed loop control circuit is typically inactive during hand-over and re-pointing period because both dishes need to receive a radio signal from a satellite. During a hand-over and re-pointing the pedestal, control typically is in an open loop configuration.

Figure 12:
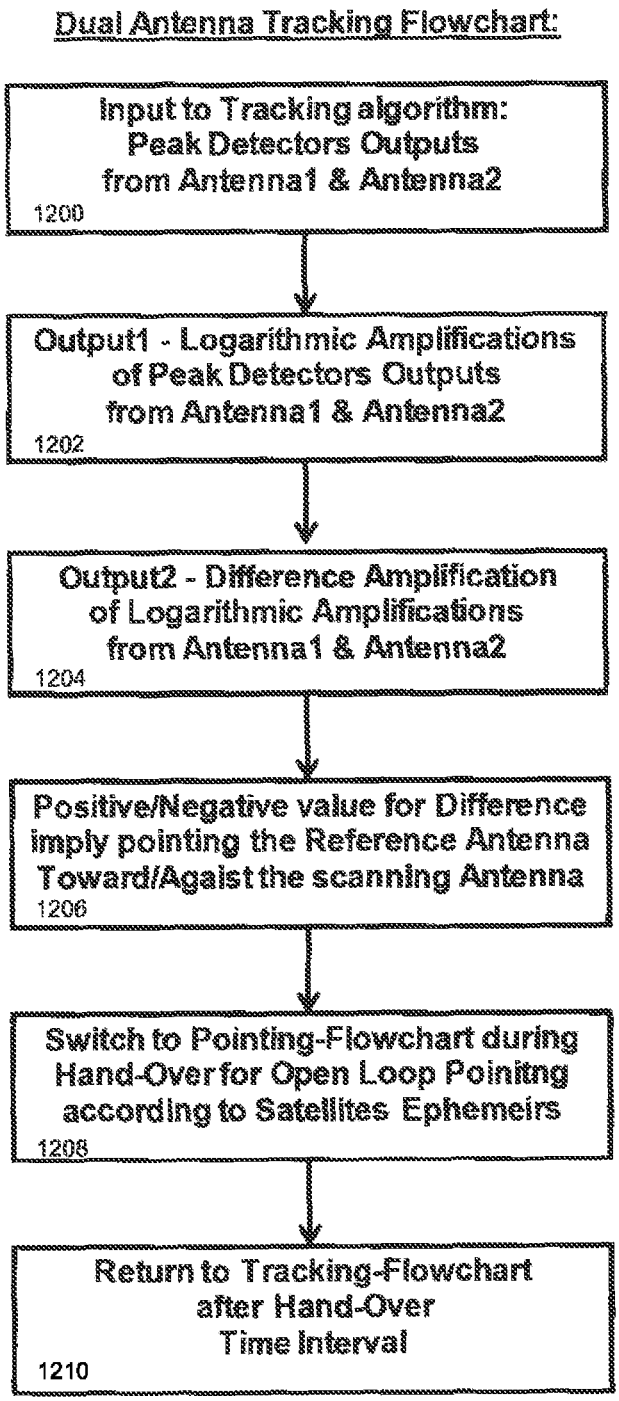
FIG. 12, a flowchart for dual antenna tracking.

Refer now to FIG. 12, a flowchart for dual antenna tracking. Typically, all the steps are performed sequentially, and all inputs and derived outputs are continually updated during operation of the antenna system (as long as tracking of the antennas toward the satellites continues).

In box 1200, input to tracking algorithm: peak detectors outputs, from antenna1 1101 and antenna2 1102. A first peak detector output is from the first antenna (antenna1 1101) and a second peak detector output is from the second antenna (antenna1 1102), each output from the antenna being processed by an OMT, FLT, and LNB then processed in a peak detector with LPF to provide each corresponding peak detector output.

In box 1202, output1 is logarithmic amplifications of peak detectors outputs from antenna1 & antenna2 (respectively output of Log Amp 1 from Pk. Det. 1+LPF and output of Log Amp 2 from Pk Det. 2+LPF).

In box 1204, output2 is difference amplification of logarithmic amplifications from antenna1 & antenna2 (output of Diff. Amp.).

In box 1206, positive/negative values for difference imply pointing the reference antenna toward/against the scanning antenna (analyzed in controller 1110).

In box 1208, switch to pointing, the tracking operation is switched during hand-over to open loop pointing according to satellites ephemeris (initiated by controller 1110).

In box 1210, return to tracking, the operation returns to closed loop tracking after hand-over time interval.

Figure 13:
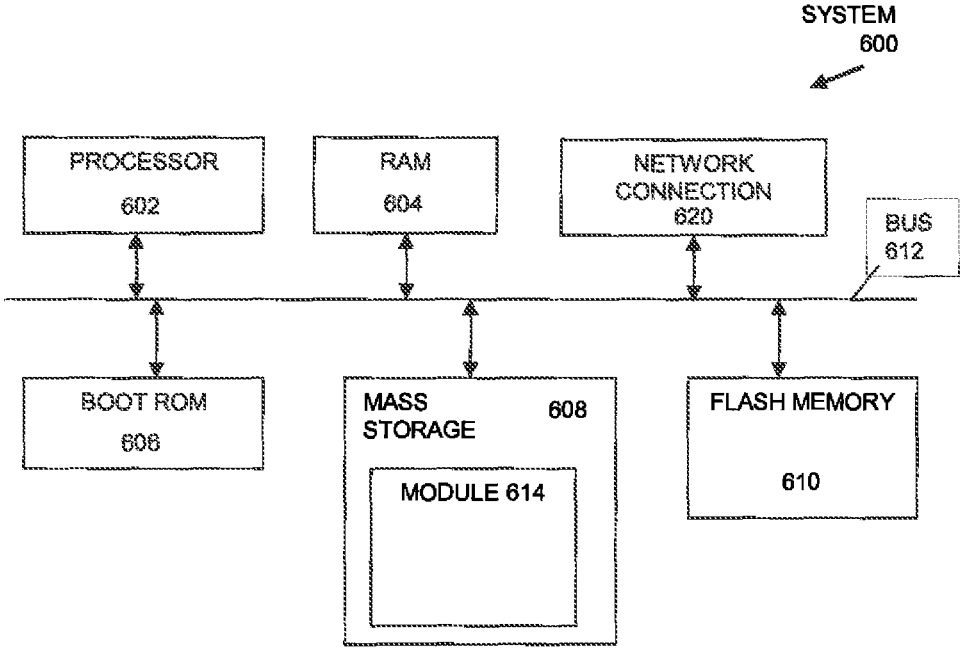
FIG. 13, a high-level partial block diagram of an exemplary system.

FIG. 13 is a high-level partial block diagram of an exemplary system 600 configured to implement the simultaneous pointing of dual antennas of the present invention. System (processing system) 600 includes a processor 602 (one or more) and four exemplary memory devices: a RAM 604, a boot ROM 606, a mass storage device (hard disk) 608, and a flash memory 610, all communicating via a common bus 612. As is known in the art, processing and memory can include any computer readable medium storing software and/or firmware and/or any hardware element(s) including but not limited to field programmable logic array (FPLA) element(s), hard-wired logic element(s), field programmable gate array (FPGA) element(s), and application-specific integrated circuit (ASIC) element(s). Any instruction set architecture may be used in processor 602 including but not limited to reduced instruction set computer (RISC) architecture and/or complex instruction set computer (CISC) architecture. A module (processing module) 614 is shown on mass storage 608, but as will be obvious to one skilled in the art, could be located on any of the memory devices.

Mass storage device 608 is a non-limiting example of a non-transitory computer-readable storage medium bearing computer-readable code for implementing the simultaneous pointing of dual antennas methodology described herein. Other examples of such computer-readable storage media include read-only memories such as CDs bearing such code.

System 600 may have an operating system stored on the memory devices, the ROM may include boot code for the system, and the processor may be configured for executing the boot code to load the operating system to RAM 604, executing the operating system to copy computer-readable code to RAM 604 and execute the code.

Network connection 620 provides communications to and from system 600. Typically, a single network connection provides one or more links, including virtual connections, to other devices on local and/or remote networks. Alternatively, system 600 can include more than one network connection (not shown), each network connection providing one or more links to other devices and/or networks.

System 600 can be implemented as a server or client respectively connected through a network to a client or server. Processing system 600 can implement controller 1110 for control of antenna systems for simultaneous pointing of dual antennas.

The choices used to assist in the description of this embodiment should not detract from the validity and utility of the invention.

The use of calculations, and any inadvertent typographical mistakes, to assist in the description of this embodiment should not detract from the utility and basic advantages of the invention.

Note that a variety of implementations for modules and processing are possible, depending on the application. Modules are preferably implemented in software, but can also be implemented in hardware and firmware, on a single processor or distributed processors, at one or more locations. The above-described module functions can be combined and implemented as fewer modules or separated into sub-functions and implemented as a larger number of modules. Based on the above description, one skilled in the art will be able to design an implementation for a specific application.

Note that the above-described examples, numbers used, and exemplary calculations are to assist in the description of this embodiment. Inadvertent typographical errors, mathematical errors, and/or the use of simplified calculations do not detract from the utility and basic advantages of the invention.

To the extent that the appended claims have been drafted without multiple dependencies, this has been done only to accommodate formal requirements in jurisdictions that do not allow such multiple dependencies. Note that all possible combinations of features that would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. A method for pointing a dual antenna toward a first satellite and second satellite, the dual antenna including a pedestal with mounted first antenna and second antenna, the method comprising the steps of:

(a) receiving pedestal location data including pedestal latitude, pedestal longitude, and pedestal altitude for the pedestal;

(b) receiving ephemeris data for the first satellite and the second satellite, said ephemeris data including respective satellite latitude, satellite longitude, satellite altitude, and orbit radius;

(c) calculating antenna pointings, based on said pedestal location data and said ephemeris data, said antenna pointings including:

(i) a first antenna elevation to the first satellite, (ii) a first antenna azimuth to the first satellite, (iii) a second antenna elevation to the second satellite, and (iv) a second antenna azimuth to the second satellite, (d) receiving pedestal misalignment data including pedestal yaw, pedestal pitch, and pedestal roll;

(e) calculating corrected antenna pointings, based on said antenna pointings and said pedestal misalignment data, said corrected antenna pointings including:

(i) a first antenna corrected elevation to the first satellite, (ii) a first antenna corrected azimuth to the first satellite, (iii) a second antenna corrected elevation to the second satellite, and (iv) a second antenna corrected azimuth to the second satellite, (f) receiving varied yaw, pitch, and roll values;

(g) deriving continuously the instantaneous corrected pointings, based on said corrected antenna pointings and said varied yaw values, said corrected pointings including:

(i) a first antenna derived elevation to the first satellite, (ii) a first antenna derived azimuth to the first satellite, (iii) a second antenna derived elevation to the second satellite, and (iv) a second antenna derived azimuth to the second satellite, (h) calculating axis angles for the dual antenna, based on said corrected pointings, said axis angles including for each yaw value:

(i) first antenna lower and upper X-axis angles, (ii) first antenna lower and upper Y-axis angles, (iii) second antenna lower and upper X-axis angles, and (iv) second antenna lower and upper Y-axis angles, and (i) deriving continuously the instantaneous working point axis angles, based on said axis angles, said working point axis angles including for a given yaw, pitch, and roll values:

(i) a dual antenna azimuth angle, (ii) a dual antenna X-axis angle, (iii) a first antenna Y-axis angle, and (iv) a second antenna Y-axis angle.

2. The method of claim 1 wherein said pedestal misalignment data is derived from the pedestal installation.

3. The method of claim 1 wherein subsequent pedestal misalignment data is derived from the pedestal dynamic movement.

4. The method of claim 1 wherein said varied yaw values are from −180° to +180° at the instantaneous pitch and roll values of the platform plate carrying the pedestal, in 0.1° steps.

5. The method of claim 1 further including the step of: initiating pointing of the dual antenna based on said working axis angles.

6. The method of claim 5 wherein pointing includes:

(i) configuring a single azimuth axis with said dual antenna azimuth angle, (ii) configuring a single X-axis with said dual antenna X-axis angle, (iii) configuring a Y1-axis of the first antenna with said first antenna Y-axis angle, and (iv) configuring an Y2-axis of the second antenna with said second antenna Y-axis angle.

7. A system for pointing an antenna, comprising:

(a) a dual antenna including a pedestal with mounted first antenna and second antenna, (b) a processing system containing one or more processors, said processing system being configured to:

(i) receive pedestal location data including pedestal latitude, pedestal longitude, and pedestal altitude for the pedestal;

(ii) receiving ephemeris data for a first satellite and a second satellite, said ephemeris data including respective satellite latitude, satellite longitude, satellite altitude, and orbit radius;

(iii) calculate antenna pointings, based on said pedestal location data and said ephemeris data, said antenna pointings including:

(A) a first antenna elevation to the first satellite, (B) a first antenna azimuth to the first satellite, (C) a second antenna elevation to the second satellite, and (D) a second antenna azimuth to the second satellite, (iv) receive pedestal misalignment data including pedestal yaw, pedestal pitch, and pedestal roll;

(v) calculate corrected antenna pointings, based on said antenna pointings and said pedestal misalignment data, said corrected antenna pointings including:

(A) a first antenna corrected elevation to the first satellite, (B) a first antenna corrected azimuth to the first satellite, (C) a second antenna corrected elevation to the second satellite, and (D) a second antenna corrected azimuth to the second satellite, (vi) receive varied yaw, pitch, and roll values;

(vii) derive continuously instantaneous corrected pointings, based on said corrected antenna pointings and said varied yaw values, said corrected pointings including:

(A) a first antenna derived elevation to the first satellite, (B) a first antenna derived azimuth to the first satellite, (C) a second antenna derived elevation to the second satellite, and (D) a second antenna derived azimuth to the second satellite, (viii) calculate axis angles for the dual antenna, based on said corrected pointings, said axis angles including for each yaw value:

(A) first antenna lower and upper X-axis angles, (B) first antenna lower and upper Y-axis angles, (C) second antenna lower and upper X-axis angles, and (D) second antenna lower and upper Y-axis angles, and (ix) derive continuously the instantaneous working point axis angles, based on said axis angles, said working point axis angles including for a given yaw, pitch, and roll values:

(A) a dual antenna azimuth angle, (B) a dual antenna X-axis angle, (C) a first antenna Y-axis angle, and (D) a second antenna Y-axis angle.

8. The system of claim 7 wherein said processing system is further configured to: initiate pointing of the dual antenna based on said working axis angles.

9. The system of claim 7 wherein said dual antenna includes:

(a) a first rotation mechanism supporting a first antenna rotatably in a first rotation direction centering around a first axis;

(b) a second rotation mechanism supporting a second antenna rotatably in the first rotation direction centering around a second axis running along or in parallel to said first axis;

(c) an elevation angle adjusting mechanism for rotatably supporting said first and second rotation mechanisms commonly in a second rotation direction, centering around a third axis different from said first axis and said second axis; and (d) an azimuth angle adjusting mechanism for rotatably supporting said elevation angle adjusting mechanism in a third rotation direction, centering around a fourth axis different from said first axis and said third axis;

wherein said first rotation mechanism is provided in a first area partitioned by a plane containing said third axis and running in parallel to said fourth axis, and said second rotation mechanism is provided in a second area opposite to said first area.

10. The system of claim 9 wherein pointing includes:

(i) configuring said fourth axis with said dual antenna azimuth angle, (ii) configuring said third axis with said dual antenna X-axis angle, (iii) configuring said first axis of the first antenna with said first antenna Y-axis angle, and (iv) configuring said second axis of the second antenna with said second antenna Y-axis angle.

11. A method for tracking a satellite using a dual antenna including a pedestal with mounted first antenna and second antenna, the method comprising the steps of:

(a) receiving a first peak detector output corresponding to a received signal at the first antenna and a second peak detector output corresponding to said received signal at the second antenna;

(b) generating respective logarithmic amplifications of said first and second peak detector outputs; and (c) generating a difference amplification of said logarithmic amplifications;

wherein the value of said difference amplification indicates if the first antenna should be pointed in the direction of the second antenna, or if the second antenna should be pointed in the direction of the first antenna, thereby tracking the satellite.

12. The method of claim 11 further including the step of: initiating changing pointing direction of said first or second antenna based on said difference amplification.

13. The method of claim 11 further including the step of: switching, during a handover, control of the first and second antennas to an open loop configuration.

14. The method of claim 11 wherein said first antenna is offset from said second antenna by a difference in the range of 0.05° to 0.15°.

15. A system for tracking, comprising:

(a) a dual antenna including a pedestal with mounted first antenna and second antenna, (b) a processing system containing one or more processors, said processing system being configured to:

(i) receive a first peak detector output corresponding to a received signal at the first antenna and a second peak detector output corresponding to said received signal at the second antenna;

(ii) generate respective logarithmic amplifications of said first and second peak detector outputs; and (iii) generate a difference amplification of said logarithmic amplifications;

wherein the value of said difference amplification indicates if the first antenna should be pointed in the direction of the second antenna, or if the second antenna should be pointed in the direction of the first antenna, thereby tracking the satellite.

16. The system of claim 15 wherein said processing system is further configured to: initiate changing pointing direction of said first or second antenna based on said difference amplification.

17. The system of claim 15 wherein said dual antenna includes:

(a) a first rotation mechanism supporting a first antenna rotatably in a first rotation direction centering around a first axis;

(b) a second rotation mechanism supporting a second antenna rotatably in the first rotation direction centering around a second axis running along or in parallel to said first axis;

(c) an elevation angle adjusting mechanism for rotatably supporting said first and second rotation mechanisms commonly in a second rotation direction, centering around a third axis different from said first axis and said second axis; and (d) an azimuth angle adjusting mechanism for rotatably supporting said elevation angle adjusting mechanism in a third rotation direction, centering around a fourth axis different from said first axis and said third axis;

wherein said first rotation mechanism is provided in a first area partitioned by a plane containing said third axis and running in parallel to said fourth axis, and said second rotation mechanism is provided in a second area opposite to said first area.

* * * * *